United States Patent [19]

Coch

[11] 3,953,248

[45] Apr. 27, 1976

[54] METHOD AND APPARATUS FOR RECLAIMING HEAT TREATING SALT

[75] Inventor: Lester Coch, Northport, N.Y.

[73] Assignee: Waldes Kohinoor, Inc., Long Island City, N.Y.

[22] Filed: Jan. 14, 1975

[21] Appl. No.: 540,867

[30] Foreign Application Priority Data

Jan. 7, 1975 Germany ..... 2500322

[52] U.S. Cl. ..... 148/15; 148/18; 148/20; 148/28

[51] Int. Cl.[2] ..... C21D 1/48

[58] Field of Search ..... 148/15, 18, 20, 28; 23/287, 272, 274; 252/71; 159/32, 47

[56] References Cited

UNITED STATES PATENTS 2,931,743 4/1960 Halgren et al. ..... 148/28

3,645,802 2/1972 Keough ..... 148/15

*Primary Examiner*—Walter R. Satterfield

*Attorney, Agent, or Firm*—Burns, Doane, Swecker & Mathis

[57] ABSTRACT

Heat treating salt used as a bath in heat treating metal articles is reclaimed from the rinsing tank in a closed cycle by removing a portion of the salt-contaminated rinse water from the rinsing tank to an enclosed portion of the heat treating tank which serves as a water evaporation zone. There the salt-contaminated rinse water is evaporated by direct contact with the hot molten salt bath and the resulting steam, either as such or after condensation, is conducted back to the rinse tank where it serves to replenish the rinse water. The salt content of the contaminated rinse water which is left behind in the water evaporation zone becomes commingled there with the molten salt bath and is thus reclaimed.

5 Claims, 1 Drawing Figure

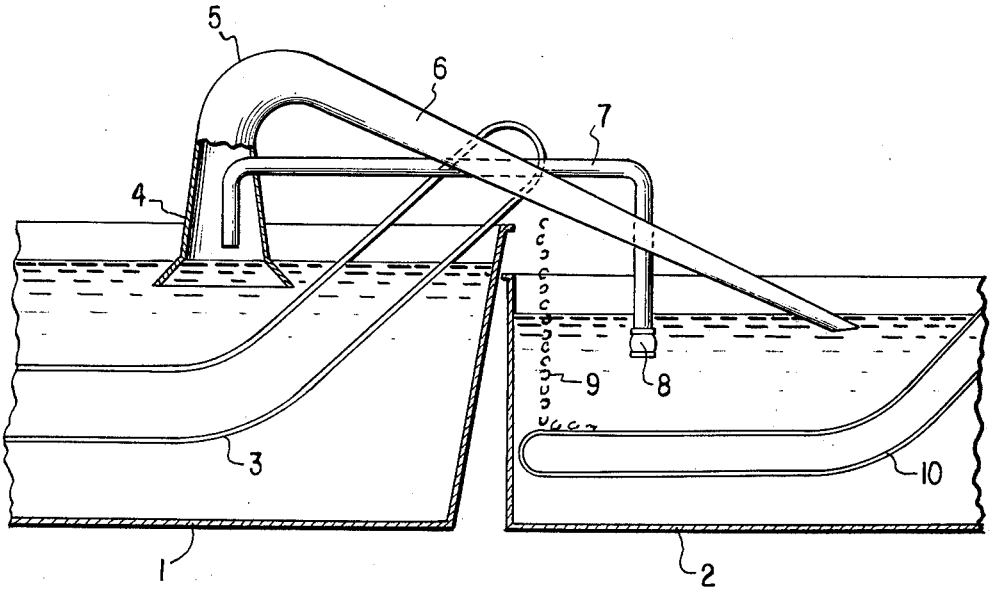
5
6
7
4
9
8
3
10
1
2

METHOD AND APPARATUS FOR RECLAIMING HEAT TREATING SALT

FIELD OF THE INVENTION AND ITS BACKGROUND

The invention concerns a method and apparatus for reclaiming a relatively high-boiling heat treating salt from the rinsing bath of heat treating units wherein the heat treating bath contains a molten heat treating salt at an elevated temperature.

When metal articles are quenched, hardened or otherwise treated in a heat treating bath in the course of a heat treating process and are thereafter washed in a rinse bath a certain quantity of the heat treating salt is carried along by the metal parts from the heat treating bath into the rinsing tank. As a consequence the rinse water in time becomes richer in its content of heat treating salt. It is the purpose of this invention to remove this salt content from the wash water tank and to reclaim the heat treating salt for the heat treating bath.

For heat treating baths which comprise a mixture of heat treating salt with a certain quantity of water, devices are known which return rinse water to the heat treating bath for the purpose of maintaining the desired water content of the heat treating bath by adding it to the mixture of heat treating salt and water contained in the salt bath. In doing this the heat treating salt contained in the rinse water is returned into the molten salt bath simultaneously with the rinse water. This type of method is useful in reclaiming heat treating salt from the wash water tank and returning it to the molten salt tank only when rinse water is intended to be added to the heat treating or quench bath for the purpose of maintaining the desired water content thereof. See, for instance, U.S. Pat. No. 2,537,830 (Holden); U.S. Pat. No. 2,931,745 (Halgren) and U.S. Pat. No. 3,645,802 (Keough). This method of reclaiming heat treating salt, however, cannot be used for such heat treating baths which do not consist of an aqueous heat treating salt mixture but only of a substantially anhydrous hot heat treating salt in its molten state.

It is therefore the purpose of this invention to make it possible in the case of heat treating units of the type which comprise a salt bath consisting essentially only of a molten heat treating salt, to reclaim in a simple and economic manner the salt content from the rinse water of the wash water tank without a constant renewal of the rinse bath and to reclaim the heat treating salt which had been carried into the wash water tank back to the heat treating bath.

THE DRAWING

The FIGURE is a schematic side elevation view, in section, of an embodiment of the invention comprising a quench tank in which metal parts are quenched in a molten salt bath and a rinse tank in which the quenched parts are rinsed, together with associated equipment used in reclaiming the entrained salt from the rinse bath.

DESCRIPTION OF A PREFERRED EMBODIMENT

According to this invention the method proposed for the solution of this task comprises pumping or otherwise transporting the rinse water, which contains water soluble heat treating salt, from the wash water tank to a bell-shaped or similarly enclosed zone which extends above and is in open communication with a portion of the salt bath surface in the heat treating tank and is thus heated by the molten heat treating salt of the treating bath. Because the heat treating bath is maintained at a temperature higher than the boiling point of the rinse water, the water fraction of the rinse water is separated from the salt fraction in this enclosed zone by substantially instantaneous evaporation on the molten salt surface and the remaining water-free salt fraction is commingled in the said enclosed area with the molten heat treating salt of the treating tank. The live steam resulting from the evaporation of the water fraction is carried away from the enclosed area and returned either as such or, if desired, in condensed condition to the rinse water of the wash water tank. In this manner not only is the heat treating salt, which had been entrained by the metal parts into the wash water tank, reclaimed for the heat treating bath, but at the same time saltfree rinse water is reclaimed for the wash water tank. The separation of rinse water and heat treating salt by the described distillation is accomplished through the heat of the molten salt bath and does not require any separate source or device for heating. In addition, since the rinse water separated from the salt fraction thereof by evaporation is carried back into the wash water tank at a relatively high temperature, the heat consumption in the rinse bath is reduced whereby the entire heat treating unit becomes more economical.

Salt bath temperatures in the heat treatment of metal objects of the kind to which this invention relates will normally fall within the range of between about 105° and 425°C. or higher, more normally between about 200° and 425°C. Many different inorganic salt bath compositions which are suitable for this purpose are well known in the art. For instance, the salt bath composition may consist essentially of the eutectic mixture of potassium nitrate and sodium nitrite; or 80% $Z(KNO_3+NaNO_2$ eutectic) and 20% Ba $(NO_3)_2$; or of ternary mixtures of potassium nitrate, sodium nitrite and sodium nitrate; or of various other known mixtures of two or more salts such as the chlorides of lithium, sodium or potassium, the corresponding nitrates, the corresponding nitrites and the corresponding sulfates. Of course, to be useful in this invention, the selected salt bath mixture must be soluble in water and must melt at a temperature lower than the treating temperature required for accomplishing the desired metal heat treatment.

The heat treatment may be carried out for any one of several purposes such as quenching, hardening, drawing or the like.

According to the invention, an aadvantageous device for carrying out the aforementioned method comprises a bell-shaped chamber located above the molten heat treating salt in the heat treating tank, the lower open end of which extends below the surface of the heat treating salt while the other, upper end of the chamber is connected to a retort-shaped pipe attached to the water tank of the heat treating unit. Additionally, the device is also equipped with a pump or metering device which either continuously or intermittently pumps a measured flow of rinse water from the wash water tank into the distillation chamber, preferably at a rate which maintains the salt concentration in the rinse tank at or below a predetermined level. The retort-like conduit serves to carry away the live steam obtained from the salty rinse water by evaporation and concomitant separation of the salt fraction therefrom. The steam is conducted from the chamber through this conduit back to the wash water tank where it serves to replenish the rinse water supply in a salt-free form. By means of this device the salt fraction can be separated from the rinse water without elaborate equipment in an economic and continuous manner whereby the salt fraction is introduced directly back into the molten salt bath and the salt-free rinse water directly back into the wash water tank.

Referring to the drawing, a quench tank 1 is shown there containing a conventional heat treating bath consisting of a substantially anhydrous molten heat treating salt composition while the wash water tank 2 contains the rinse water. The quench tank 1 is equipped with an otherwise conventional conveyor 3 which carries the quenched metal parts 9 out of the salt bath into the rinse bath and a conveyor 10 which carries the rinsed metal parts out of the rinse tank 2. In this process the metal parts carry along some of the molten heat treating salt from tank 1 to tank 2 whereby the salt content of the rinse water in tank 2 increases.

In order to remove the salt content from the rinse bath and to reclaim the heat treating salt which had been carried into the rinse bath back into the salt bath, the salt bath 1 is equipped above the surface of the liquid heat treating salt with a bell-shaped hood 4 which reaches with its lower open end somewhat below the surface of the salt bath. The upper part of the hood 4 is equipped with a steam conduit 5 which is connected by an inclined conduit 6 with the wash water tank 2. Conduit 6 preferably extends beneath the surface of the wash water, especially if steam is passed through it in uncondensed form.

A conduit 7 is also provided which leads from the wash tank 2 into an upper portion of the hood 4 and preferably faces downward within this hood 4 so as to discharge its contents directly onto the hot salt bath surface. Conduit 7 is equipped with a metering device or pump 8 which sucks rinse water out of the wash water tank 2 at a predetermined or measured rate. By means of said pump 8 the measured flow of salty rinse water is carried from the wash water tank 2 into the hood 4. There the water is immediately flashed off and converted into live steam upon contact with the hot molten salt bath whereby the rinse water is separated from its salt content which does not evaporate.

The salt-free live steam obtained through evaporation of the water fraction of the rinse water leaves the hood 4 through the steam conduit 5 and is returned through the conduit 5 directly back to the wash water tank 2 either in the form of hot water or as steam which becomes condensed upon introduction into the rinse bath. The separated salt fraction of the rinse water, which does not evaporate, remains within the confines of the hood 4 and passes from there directly into and becomes commingled with the main body of the molten salt bath. The salt is thus reclaimed from the wash water in a closed cycle wherein the salt-containing water passes from the wash tank through a conduit to a segregated evaporation section in the heat treating tank, and the steam liberated in this evaporation section is returned from the heat treating tank either as such or as water through another conduit back to the wash tank for further use as wash water therein.

What is claimed is:

1. In a process for reclaiming heat treating salt from the rinsing zone of a heat treating unit wherein metal parts are treated in a hot molten treating bath consisting essentially of molten, substantially anhydrous, water soluble heat treating salt in a treating zone and then rinsed in an aqueous liquid bath in a rinsing zone, the improvement which comprises transferring the aqueous liquid after contamination by entrained salt from the rinsing zone to an enclosed distillation zone within the treating zone which distillation zone has an open lower end extending into said hot molten salt bath below the surface thereof in said treating zone, maintaining said molten salt bath at a temperature higher than the boiling point of said aqueous liquid whereby water contained in said aqueous liquid transferred to said distillation zone is evaporated at or above the surface of said salt bath therein and the salt contained in said aqueous liquid remains behind in said distillation zone and is commingled with said molten salt bath therein, and conducting the evaporated water fraction from said distillation zone to said rinsing zone for replenishing the aqueous bath therein.

2. A process according to claim 1 wherein the treating bath consists of a substantially anhydrous nitrate-nitrite mixture.

3. Apparatus for closed-cycle reclaiming of heat treating salt which comprises a first tank (1) comprising a floor and sidewalls for containing a molten metal salt bath of a certain depth for heat treating metal articles therein, a bell-shaped chamber (4) located above a portion of the floor of said first tank and having an open lower end extending to a level below that to which said molten salt bath is designed to extend, a second tank (2) comprising a floor and sidewalls for containing a bath of aqueous wash liquid, a first transfer means (3) for transferring metal articles from said first tank to said second tank, a second transfer means (10) for removing metal articles from said second tank, a first conduit means (7) for conducting said aqueous liquid from said second tank to a point in said bell-shaped chamber (4) above the level to which said molten salt is designed to extend, and a second conduit means (6) openly communicating with an upper portion of said bell-shaped chamber (4) and extending into said second tank (2) for conducting water evaporated in said bell-shaped chamber (4) back to said aqueous bath in said second tank (2).

4. Apparatus according to claim 3 wherein said first conduit means (7) includes a pump means.

5. Apparatus according to claim 3 wherein said second conduit means (6) terminates in said second tank (2) at a point below the level to which said aqueous bath is designed to extend.

* * * * *